US006582629B1

(12) United States Patent
Lin et al.

(10) Patent No.: US 6,582,629 B1
(45) Date of Patent: Jun. 24, 2003

(54) COMPOSITIONS FOR CERAMIC IGNITERS

(75) Inventors: Roger J. Lin, San Jose, CA (US); Craig A. Willkens, Sterling, MA (US); Kevin C. Solofra, Milford, MA (US); Thomas J. Sheridan, Oakham, MA (US)

(73) Assignee: Saint-Gobain Ceramics and Plastics, Inc., Worcester, MA (US)

( * ) Notice: Subject to any disclaimer, the term of this patent is extended or adjusted under 35 U.S.C. 154(b) by 0 days.

(21) Appl. No.: 09/468,271

(22) Filed: Dec. 20, 1999

(51) Int. Cl.[7] ..... H01B 1/66

(52) U.S. Cl. ..... 252/516; 252/518; 501/89; 501/92; 501/96; 501/98; 219/270

(58) Field of Search ..... 252/516, 518; 501/89, 92, 98, 96; 219/270

(56) References Cited

U.S. PATENT DOCUMENTS

| | | | | |
|---|---|---|---|---|
| 3,875,477 | A | 4/1975 | Fredriksson et al. | 317/98 |
| 3,974,106 | A | 8/1976 | Richerson | 252/516 |
| 4,429,003 | A | 1/1984 | Fredriksson et al. | 428/317.9 |
| 4,652,727 | A | 3/1987 | Hoshizaki et al. | 219/541 |
| 5,045,237 | A | 9/1991 | Washburn | 252/516 |
| 5,085,804 | A | 2/1992 | Washburn | 252/516 |
| 5,191,508 | A | 3/1993 | Axelson et al. | 361/257 |
| 5,514,630 | A | 5/1996 | Willkens et al. | 501/89 |
| 5,564,618 | A | 10/1996 | Axelson | 428/124.1 |
| 5,705,261 | A | 1/1998 | Axelson | 228/120 |
| 5,785,911 | A | 7/1998 | Willkens et al. | 264/86 |
| 5,786,565 | A | 7/1998 | Willkens et al. | 219/260 |
| 5,801,361 | A | 9/1998 | Willkens et al. | 219/270 |
| 5,804,092 | A | 9/1998 | Axelson et al. | 219/270 |
| 5,820,789 | A | 10/1998 | Willkens et al. | 252/516 |
| 5,892,201 | A | 4/1999 | Croucher et al. | 219/267 |
| 6,028,292 | A | 2/2000 | Willkens et al. | |

FOREIGN PATENT DOCUMENTS

EP 0 635 993 A2 1/1995

OTHER PUBLICATIONS

Yamamoto et al., "Sintered Composite of $MoSi_2$–Granular $Al_2O_3$", *Journal of the Ceramic Society of Japan*, vol. 87, No. 1001, (1979), pp. 18–22.

Yamamoto et al., "Study on High Temperature Thermistor Made of $MoSi_2$– Granular $Al_2O_3$ Composite", *J. Ceram. Soc. Jpn Inter. Ed.*, vol. 97, (1989) pp. 770–774.

*Primary Examiner*—Yogendra N. Gupta
*Assistant Examiner*—Derrick G Hamlin
(74) *Attorney, Agent, or Firm*—Mike W. Crosby; Peter F. Corless; Edwards & Angell

(57) ABSTRACT

Ceramic igniter compositions are provided that contain components of conductive material and insulating material, where the insulating material component includes a relatively high concentration of metal oxide. Ceramic igniters of the invention are particularly effective for high voltage use, including throughout the range of from about 187 to 264 volts.

19 Claims, 1 Drawing Sheet

COMPOSITIONS FOR CERAMIC IGNITERS

BACKGROUND OF THE INVENTION

1. Field of the Invention

The invention relates to ceramic igniter compositions, and m ore particularly, to such compositions that contain components of a conductive material and insulating mate rial, where the insulating material component includes a relatively high concentration of metal oxide.

2. Background

Ceramic materials have enjoyed great success as igniters in gas fired furnaces, stoves and clothes dryers. Ceramic igniter production requires constructing an electrical circuit through a ceramic component, portion of which is highly resistive and rises in temperature when electrified by a wire lead.

One conventional igniter, the Mini-Igniter™, available from the Norton Igniter Products of Milford, N.H., is designed for 12 volt through 120 volt applications and has a composition comprising aluminum nitride ("AlN"), molybdenum disilicide ("$MoSi_2$") and silicon carbide ("SiC"). However, while the Mini-Ignite™ is a highly effective product, certain applications require voltages in excess of 120 V.

In particular, in Europe, nominal voltages include 220 V. (e.g. Italy), 230 V (e.g. France), and 240 V (e.g. U.K.). Standard igniter approval tests require operation at a range of from 85 percent to 110 percent of a specified nominal voltage. Thus, for a single igniter to be approved for use throughout Europe, the igniter must be operational from about 187 to 264 V (i.e. 85% of 220 V and 110% of 240 V). Current igniters have difficulty providing such a high and extended voltage range, particularly where a relatively short hot zone length (e.g. about 1.2 inches or less) is employed.

For instance, at higher voltage applications, current igniters may be subject to temperature runaway and thus require a transformer in the control system to step down the voltage. Use of such a transformer device is clearly less desirable. Accordingly, there is a need for relatively small igniters for high voltage applications, particularly over a range of from about 187 to 264 V, which do not require an expensive transformer but still possess the following requirements set by appliance and heating industries to anticipate variation in line voltage:

| | |
|---|---|
| Time to temperature ("TTT") | <5 sec |
| Minimum temperature at 85% of design voltage | 1100° C. |
| Design temperature at 100% of design voltage | 1300° C. |
| Maximum temperature at 110% of design voltage | 1500° C. |
| Hot-zone Length | <1.2–1.5" |
| Power | <100 W. |

For a given igniter geometry, one possible route to provide a higher voltage system is by increasing the igniter's resistance. The resistance of any body is generally governed by the equation $$Rs=Ry\times L/A,$$

wherein

Rs=Resistance;

Ry=Resistivity;

L=the length of the conductor; and

A=the cross-sectional area of the conductor.

Because the single leg length of current ceramic igniters is about 1.2 inches, the leg length can not, be increased significantly without reducing its commercial attractiveness. Similarly, the cross-sectional area of the smaller igniter, between about 0.0010 and 0.0025 square inches, will probably not be decreased for manufacturing reasons.

U.S. Pat. No. 5,405,237 ("the Washburn patent") discloses compositions suitable for the hot zone of a ceramic igniter comprising (a) between 5 and 50 volume % ("v/o" or "vol%") $MoSi_2$, and (b) between 50 and 95 v/o of a material selected from the group consisting of silicon carbide, silicon nitride, aluminum nitride, boron nitride, aluminum oxide, magnesium aluminate, silicon aluminum oxynitride, and mixtures thereof.

Additional highly useful ceramic compositions and systems are disclosed in U.S. Pat. Nos. 5,514,630 and 5,820,789, both to Willkens et al. U.S. Pat. No. 5,514,630 reports that hot zone compositions should not exceed 20 v/o of alumina. U.S. Pat. No. 5,756,215 reports additional sintered compositions that include lead layers that contain up to 2% by weight of silicon carbide.

It thus would be desirable to have new ceramic hot zone igniter compositions. It would be particularly desirable to have new igniter compositions that could reliably operate at high voltages, such as from about 187 to 264 V, especially with a relatively. short hot zone length.

SUMMARY OF THE INVENTION

We have now discovered new ceramic compositions that are particularly effective for high voltage use, including over a range of 187 to 264 V.

More specifically, in one aspect of the invention, ceramic hot zone compositions of the invention contain at least three components: 1) conductive material; 2) semiconductor material; and 3) insulating material, where the insulating material component includes a relatively high concentration of metal oxide, such as alumina.

It has been surprisingly found that such high concentration (e.g. at least about 25 or 30 v/o of the insulating material component) of a metal oxide provides a ceramic composition that can reliably provide a high nominal voltage, including 220, 230 and 240 V.

Moreover, ceramic hot zone compositions of the invention have been repeatedly demonstrated to reliably provide a line voltage over an extremely broad, high voltage range, including from about 187 to about 264 V. Hence, igniters of the invention can be employed throughout Europe, and reliably operate within 85 percent and 110 percent of the several distinct high voltages utilized in the various European countries. It also should be appreciated that while certain conventional hot zone compositions may provide a reliable voltage at a specified high voltage, those compositions often fail as voltage is varied over a broader range. Accordingly, the compositions of the invention that provide reliable, prolonged performance over an extended high voltage range clearly represent a significant advance.

While hot zone compositions of the invention are particularly effective for high voltage use, it has been found that the compositions also are highly useful for lower voltage applications, including for 120 V or even lower voltages such as 6, 8, 12 or 24 V applications.

Preferred ceramic igniters of the invention have a hot zone composition comprising:

(a) an electrically insulating material having a resistivity of at least about $10^{10}$ ohm-cm;

(b) between about 3 and about 45 v/o of a semiconductive material having a resistivity of between about 1 and about $10^8$ ohm-cm, preferably between about 5 and about 45 v/o of the hot zone composition being composed of the semiconductive material;

(c) a metallic conductor having a resistivity of less than about $10^{-2}$ ohm-cm, preferably between about 5 and about 25 v/o of the hot zone composition being composed of the metallic conductor, and wherein at least about 21 v/o of the hot zone composition comprises a metal oxide insulating material. Preferably, at least about 25 v/o of the hot zone composition comprises a metal oxide insulating material such as alumina, more preferably at least about 30, 40, 50, 60, 70 or 80 of the hot zone composition comprises a metal oxide. insulating material such as alumina, Preferably at least about 25 v/o of the insulating material is composed of a metal oxide such as alumina, more preferably at least about 30, 40, 50, 60, 70, 80 or 90 v/o of the insulating material being composed of a metal oxide such as alumina. Also preferred is where the sole insulating material component is a metal oxide. Preferably the hot zone composition comprises between about 25 and about 80 v/o of the insulating material, more preferably between about 40 and about 70 v/o of the hot zone composition is composed of the insulating material.

Additional preferred ceramic igniters of the invention have a hot zone composition comprising an electrically insulating material having a resistivity of at least about $10^{10}$ ohm-cm, with a substantial portion of that insulating material being composed of a metal oxide such as alumina; a semiconductor material that is a carbide such as silicon carbide in an amount of at least about 3, 4, 5 or 10 v/o; and a metallic conductor.

In a further aspect of the invention, preferred ceramic igniters of the invention have a hot zone composition that is substantially free of a carbide such as SiC. Such compositions comprise a metallic conductor and an electrically insulating material having a resistivity of at least about $10^{10}$ ohm-cm, with a portion of that insulating material being composed of a metal oxide such as alumina, and the insulating material component also containing a further insulating material that is not an oxide, e.g. a nitride such as AlN. Such compositions may contain the same or similar amounts as discussed above for the tertiary insulating material/semiconductor material/electrically conducting material compositions.

Hot surface ceramic igniters of the invention can be produced with quite small hot zone lengths, e.g. about 1.5 inches or less, or even about 1.3, 1.2 or 1.0 inches or less, and reliably used at high voltages, including from about 187 to 264 V, in the absence of any type of electronic control device to meter power to the igniter. It will be understood herein that for multiple-leg geometry ingiters (e.g. a hairpin slotted deign), the hot zone length is the length of the hot zone along a single leg of the multiple-leg igniter.

Moreover, igniters of the invention can heat rapidly to operational temperatures, e.g. to about 1300° C., 1400° C. or 1500° C. in about 5 or 4 seconds or less, or even 3, 2, 5 or 2 seconds or less.

Preferred hot zone compositions of the invention also can exhibit dramatic high temperature capability, i.e. repeated exposure to high temperatures without failure. The invention thus includes ignition methods that do not require renewed heating of the igniter element with each fuel ignition. Rather, the igniter can be continuously run at an elevated ignition temperature for extended periods to provide immediate ignition e.g. during a flame-out. More specifically, igniters of the invention can be run at an elevated temperature (e.g. about 800° C., 1000° C., 1100° C., 1200° C., 1300° C., 1350° C. etc.) for extended periods without a cooling period, e.g. at such temperatures for at least 2, 5, 10, 20, 30, 60, 120 minutes or more.

Other aspects of the invention are disclosed infra.

DETAILED DESCRIPTION OF THE INVENTION

Figure 1:
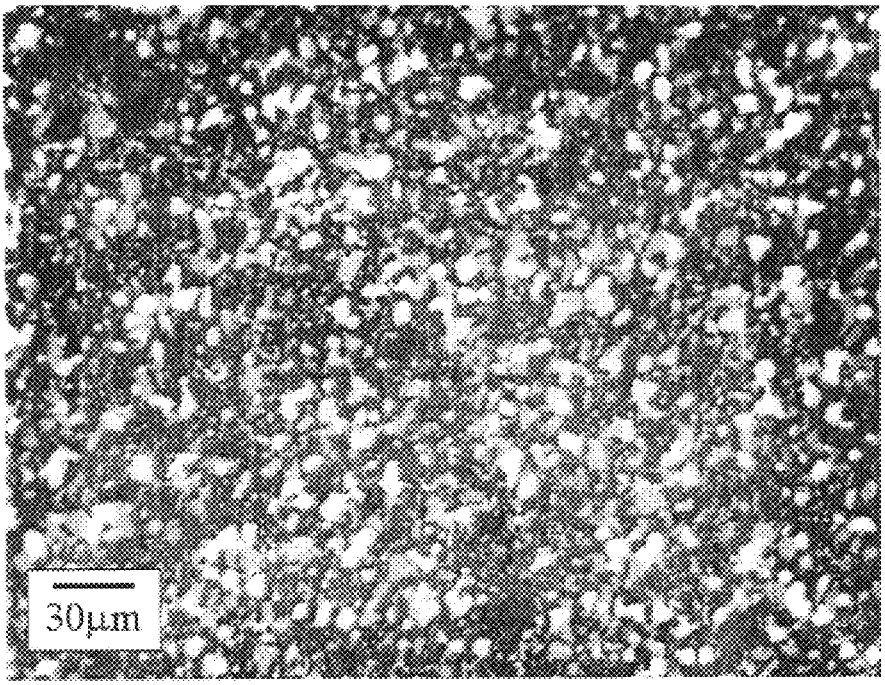
FIG. 1 shows a microstructure of a preferred tertiary hot zone composition of the invention wherein the $Al_2O_3$ is gray, the SiC is light gray, and the $MoSi_2$ is white.

As indicated above, in a first aspect, the invention provides a sintered ceramic igniter element comprising two cold zones with a hot zone disposed therebetween, the hot zone comprising a hot zone composition that comprises: (a) an electrically insulating material; (b) at least about 3 vol % of a semiconductive material; and (c) a metallic conductor having a resistivity of less than about $10^{-2}$ ohm-cm, wherein at least about 21 vol % of the hot zone composition comprises a metal oxide insulating material.

A sintered ceramic is also provided having a hot zone composition comprising (a) between 25 and 80 vol % of an electrically insulating material; (b) between 3 and 45 vol % of a semiconductive material; and (c) between 5 and 25 vol % of a metallic conductor having a resistivity of less than about $10^{-2}$ ohm-cm, wherein at least about 21 vol % of the hot zone composition comprises a metal oxide insulating material.

A further sintered ceramic is provided having a hot zone composition comprising (a) an electrically insulating material, the insulating material containing a nitride and a metal oxide; and (b) a metallic conductor having a resistivity of less than about $10^{-2}$ ohm-cm, and the hot zone composition is substantially free of a carbide material.

Methods of igniting gaseous fuel are also provided, which in general comprise applying an electric current across an igniter of the invention.

As discussed above, it has been unexpectedly discovered that adding a significant volume of a metal oxide to a ceramic hot zone composition can yield a ceramic igniter that can be used effectively under a high nominal voltage, including 220, 230 or 240 V. Moreover, these hot zone compositions can be useful over an extremely wide range of voltages, and thus the compositions also can be employed for lower voltage applications, for example for 120 V or even lower voltages such as 6 to 24 V applications.

Suitable metal oxides for use in the insulating material component include e.g. aluminum oxide, metal oxynitride such as aluminum oxynitride and silicon oxynitride, magnesium aluminum oxide and silicon aluminum oxide. For purposes of this invention, a metal oxynitride is considered a metal oxide. In some embodiments, metal oxides will be preferred that contain no nitrogen component, i.e. the metal oxide contains no nitrogen atoms. Aluminum oxide ($Al_2O_3$) is a generally preferred metal oxide. A mixture of distinct metal oxides also may be employed if desired, although more typically a single metal oxide is employed.

For purposes of the present invention, the term electrically insulating material refers to a material having a room temperature resistivity of at least about $10_{10}$ ohm-cm. The electrically insulating material component of hot zone compositions of the invention. may be comprised solely of one or more metal oxides, or alternatively, the insulating component may contain materials in addition to the metal oxide(s). For instance, the insulating material component may additionally contain a nitride such as a aluminum nitride, silicon nitride or boron nitride; a rare earth oxide (e.g., yttria); or a rare earth oxynitride. A preferred added material of the insulating component is aluminum nitride (AlN). It is believed that use of an additional insulating material such as aluminum nitride in combination with a metal oxide can provide the hot zone with desirable thermal expansion compatibility properties while maintaining desired high voltage capabilities.

As discussed above, the insulating material component contains as a significant portion one or more metal oxides. More specifically, at least about 25 v/o of the insulating material composed is composed of one or more metal oxides, more preferably, at least about 30, 40, 50, 60, 70, 75, 80, 85, 90, 95 or 98 v/o of the insulating material is composed of one or more metal oxides such as alumina.

Preferred hot zone compositions of the invention include those that contain an insulating material component that is a combination of solely a metal oxide and a metal nitride, particularly a combination of alumina ($Al_2O_3$) and aluminum nitride (AlN). Preferably the metal oxide is the major portion of that combination, e.g. where the insulating component contains at least about 50, 55, 60, 70, 80, 85, 90, 95 or 98 v/o of a metal oxide such as alumina, with the balance being a metal nitride such as aluminum nitride.

Preferred hot zone compositions of the invention also include those where the insulating material component consists entirely of one or more metal oxides such as alumina.

When alumina is added to the green body of a hot zone composition, any conventional alumina powder may be selected. Typically, alumina powder having an average grain size of between about 0.1 and about 10 microns, and only about 0.2 w/o impurities, is used. Preferably, the alumina has a grain size of between about 0.3 and about 10 $\mu$m. More preferably, an Alcoa calcined alumina, available from Alcoa Industrial Chemicals of Bauxite, Ark., is used. Additionally, alumina may be introduced in forms other than a powder, including, but not limited to, alumina sol-gel approaches and hydrolysis of a portion of the aluminum nitride.

In general, preferred hot zone compositions include (a) between about 50 and about 80 v/o of an electrically insulating material having a resistivity of at least about $10^{10}$ ohm-cm; (b) between about 5 and about 45 v/o of a se miconductive material having a resistivity of between about 10 and about $10^8$ ohm-cm; and (c) between about 5 and about 25 v/o of a metallic conductor having a resistivity of less than about $10^{-2}$ ohm-cm. Preferably, the hot zone comprises 50–70 v/o electrically insulating ceramic, 10–45 v/o of the semiconductive ceramic, and 6–16 v/o of the conductive material.

If the electrically insulating ceramic component is present as more than about 80 v/o of the hot zone composition, the resulting composition can become too resistive and is unacceptably slow in achieving target temperatures at high voltages. Conversely, if it is present as less than about 50 v/o (e.g. when the conductive ceramic is present at about 8 v/o), the, resulting ceramic becomes too conductive at high voltages. Clearly, when the conductive ceramic fraction is raised above 8 v/o, the hot zone is more conductive and the upper and lower bounds of the insulating fraction can be suitably raised to achieve the required voltage.

As discussed above, in a further aspect of the invention, ceramic hot zone compositions are provided that are at least substantially free of a carbide such as SiC, or preferably any other semiconductive material. Such compositions comprise a metallic conductor and an electrically insulating material having a resistivity of at least about $10^{10}$ ohm-cm, with a substantial portion of that insulating material being composed of a metal oxide such as alumina, and the insulating material component also containing a further material that is not an oxide, e.g. a nitride such as AlN. Preferably, such compositions contain less than about5 v/o of a carbide, more preferably the compositions contain less than about 2, 1, 0.5 v/o of a carbide, or even more preferably such hot zone compositions are completely free of a carbide, or other semiconductive material.

For the purposes of the present invention, a semiconductive ceramic (or "semiconductor") is a ceramic having a room temperature resistivity of between about 10 and $10^8$ ohm-cm. If the semiconductive component is present as more than about 45 v/o of the hot zone composition (when the conductive ceramic is in the range of about 6–10 v/o), the resultant composition becomes too conductive for high voltage applications (due to lack of insulator). Conversely, if it is present as less than about 10 v/o (when the conductive ceramic is in the range of about 6–10 v/o), the resultant composition becomes too resistive (due to too much insulator). Again, at higher levels of conductor, more resistive mixes of the insulator and semiconductor fractions are needed to achieve the desired voltage. Typically, the semiconductor is a carbide selected from the group consisting of silicon carbide (doped and undoped), and boron carbide. Silicon carbide is generally preferred.

For the purposes of the present invention, a conductive material is one which has a room temperature resistivity of less than about $10^{-2}$ ohm-cm. If the conductive component is present in an amount of more than about 25 v/o of the hot zone composition, the resultant ceramic becomes too conductive for high voltage applications, resulting in an unacceptably hot igniter. Conversely, if it is present as less than about 6 v/o, the resultant ceramic becomes too resistive for high voltage applications, resulting in an unacceptably cold igniter. Typically, the conductor is selected from the group. consisting of molybdenum disilicide, tungsten disilicide, and nitrides such as titanium nitride, and carbides such as titanium carbide. Molybdenum disilicide is generally preferred.

Particularly preferred hot zone compositions of the invention contain aluminum oxide, molybdenum disilicide and silicon carbide, with aluminum nitride optionally being employed as an additional material of the insulating material component.

The hot zone/cold zone igniter design as described in the Washburn patent (U.S. Pat. No. 5,405,237) may be suitably used in accordance with the present invention. The hot zone provides the functional heating for gas ignition. For high voltage applications (e.g. 187 to 264 V), the hot zone preferably has a resistivity of about 1–3 ohm-cm in the temperature range of 1000° to 1600° C. A specifically preferred hot zone composition comprises about 50 to 80 v/o $Al_2O_3$, about 5–25 v/o $MoSi_2$ and 10–45 v/o SiC. More preferably, it comprises about 60 to 80 v/o aluminum oxide, and about 6–12 v/o $MoSi_2$, 15–30 v/o SiC. In one especially preferred embodiment, the hot zone comprises about 66: v/o $Al_2O_3$, 14 v/o $MoSi_2$, and 20 v/o SiC.

In preferred embodiments the average grain size (d50) of the hot zone components in the densified body is as follows:

a) insulator (e.g. $Al_2O_3$, AlN, etc.): between about 2 and 10 microns;

b) semiconductor (e.g., SiC): between about 1 and 10 microns; and c) conductor (e.g., $MoSi_2$): between about 1 and 10 microns.

FIG. 1 discloses a microstructure of a preferred hot zone composition of the invention that consists of a sintered blend of $Al_2O_3$, SiC and $MoSi_2$. As can be seen FIG. 1, the composition has a relatively homogenous arrangement of components, i.e. the components are well distributed throughout the composition and the microstructure is at least essentially devoid of any large areas (e.g. 30, 40 or 50 sum width) of a single composition component. Moreover, the conductive material ($MoSi_2$) component areas have coherent, defined edges and are not feathery.

Figure 2:
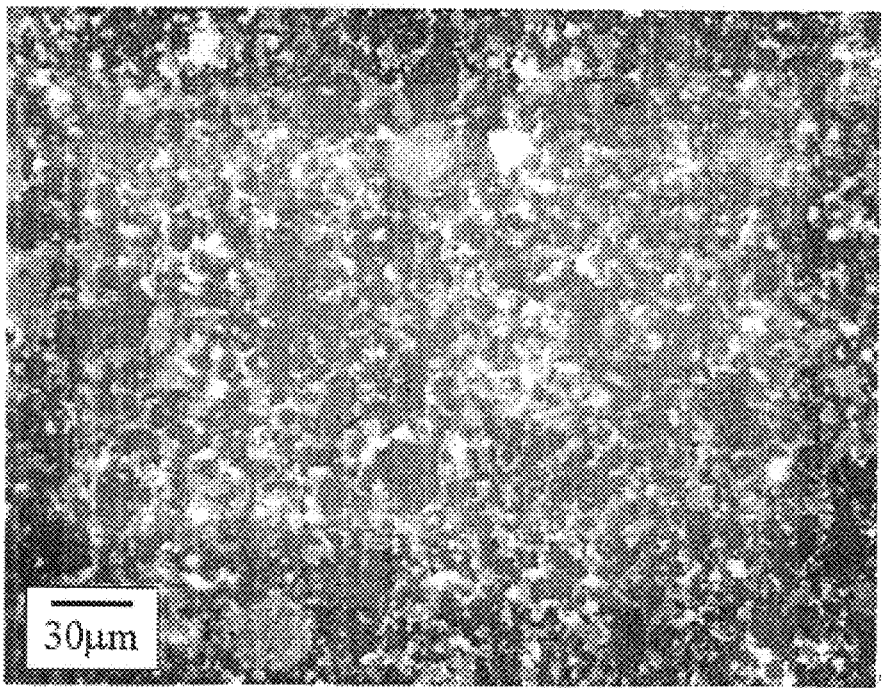
FIG. 2 (prior art)
FIG. 2 shows a microstructure of a prior hot zone composition that contains no metal oxide wherein AlN is gray, SiC is light gray and the $MoSi_2$ is white.

FIG. 2 shows a shows a microstructure of a prior hot zone composition that contains no metal oxide. In FIG. 2, the conductive material ($MoSi_2$) component areas do not have well-defined boundaries and instead are diffuse and "feather-like".

Igniters of the invention can have a variety of configurations. A preferred design is a slotted system, such as a horseshoe or hairpin design. A straight rod shape (slotless) also may be employed, with cold ends or terminal connecting ends on opposing ends of the body.

Igniters of the invention typically also contain at least one low resistivity cold zone region in electrical connection with the hot zone to allow for attachment of wire leads to the igniter. Typically, a hot zone composition is disposed between two cold zones. Preferably, such cold zone regions are comprised of e.g. AlN and/or $Al_2O_3$ or. other insulating material; SiC or other semiconductor material; and $MoSi_2$ or other conductive material. However, cold zone regions will have a significantly higher percentage of the conductive and semiconductive materials (e.g., SiC and $MoSi_2$) than does the hot zone. Accordingly, cold zone regions typically have only about ⅕ to 1/1000 of the resistivity of the hot-zone composition and do not rise in temperature to the levels of the hot zone. A preferred cold zone composition comprises about 15 to 65 v/o aluminum oxide, aluminum nitride or other insulator material; and about 20 to 70 v/o $MoSi_2$ and SiC or other conductive and semiconductive material in a volume ratio of from about 1:1 to about 1:3. More preferably, the cold zone comprises about 15 to 50 v/o AlN and/or $Al^2O_3$, 15 to 30 v/o SiC and 30 to 70 v/o $MoSi_2$. For ease of manufacture, preferably the cold zone composition is formed of the same materials as the hot zone composition, with the relative amounts of semiconductive and conductive materials being greater.

A specifically preferred cold zone compositions for use in igniters of the invention contains 60 v/o $MoSi_2$, 20 v/o SiC and 20 v/o $Al_2O_3$. A particularly preferred cold zone compositions for use in igniters of the invention contains 30 v/O $MoSi_2$, 20 v/o SiC and 50 v/o $Al_2O_3$.

The dimensions of the igniter can affect its properties and performance. In general, the single leg length of the hot zone should be greater than about 0.5 inches (to provide enough mass so that cooling convective gas flow will not significantly affect its temperature) but less than about 1.5 inches (to provide sufficient mechanical ruggedness). Its width should be greater than about 0.1 inches to provide sufficient strength and ease of manufacture. Similarly, its thickness should be more than about 0.02 inches to provide sufficient strength and ease of manufacture. Preferably, an igniter of the invention is typically between about 1.25 and about 2.00 inches in total single leg length, have a hot zone cross-section of between about 0.001 and about 0.005 square inches (more preferably, less than 0.0025 square inches), and are of a two-legged hairpin design. For a referred two-legged hairpin igniter useful over voltages of from 187 to 264 volts, and having a hot zone composition of about 66 v/o $Al_2O_3$, about 20 v/o SiC, and about 14 v/o $MoSi_2$, the following igniter dimensions are preferred: length of about 1.15 inches; width of about 0.047 inches; and thickness of about 0.030 inches.

In general, hot surface ceramic igniters of the invention can be produced with quite small hot zone lengths, e.g. about 1.5 inches or less, or even about 1.4, 1.3, 1.2, 1.1, 1.0, 0.9, 0.8 inches or less, and reliably used at high voltage ranges, including from about 220 to 240 V, and in the absence of any type of electronic control device to meter power to the igniter.

An important performance property of a ceramic igniter, particularly where gas is the fuel, is time to temperature ("TTT"), i.e. the time for the igniter hot zone to rise from room temperature to the fuel (gas) ignition temperature. Igniters of the invention can heat rapidly,to operational temperatures, e.g. to about 1300° C., 1400° C. or 1500° C. in about 5 or 4 seconds or less, even 3 seconds or less, or even 2.75, 2.5, 2.25 or 2 second or less.

It has been found that hot zone compositions of the invention exhibit extremely high temperature capability, e.g. up to 1750° C. without serious oxidation or burnout problems. Tested conventional systems failed upon repeated exposure to 1600° C. In contrast, preferred hot zone compositions of the invention survive "life testing" at such high temperatures, e.g. 50,000 cycles of 30 seconds on:30 seconds off at 1450° C. It also has been found that igniters of the invention exhibit significantly decreased amperage and temperature variations over such heating test cycles, relative to prior compositions.

As discussed above, the invention includes ignition methods that do not require renewed heating of a ceramic igniter. Rather, the igniter can be run for extended periods, at an elevated temperature sufficient for fuel ignition, and without the need for constant on/off (i.e. heating/cooling) cycling.

The processing of the ceramic component (i.e., green body processing and sintering conditions) and the preparation of the igniter from the densified ceramic can be done by conventional methods. Typically, such methods are carried out in substantial accordance with the Washburn patent. See also the examples which follow, for illustrative conditions. Sintering of a hot zone composition is preferably conducted at relatively high temperatures, e.g. at or slightly above about 1800° C. Sintering typically will be conducted under pressure, either under a uniaxial press (hot press) or a hot isostatic press (HIP).

It also has been surprisingly found that hot zone compositions of the inventions can be effectively densified in a single high temperature (e.g. at least about 1800 or 1850° C.) isostatic press, in contrast to prior compositions.

Prior hot zone compositions have required two separate sintering procedures, a first warm press (e.g. less than 1500° C. such as 1300° C.), followed by a second high temperature sintering (e.g. 1800 or 1850° C.). The first warm sintering provides a densification of about 65 to 70 % relative to theoretical density, and the second higher temperature sintering provides a final densification of greater than 99 % relative to theoretical density. Prior hot zone compositions have required a density of in excess of 99 % in order to provide acceptable electrical properties.

The single high temperature sintering of the hot zone compositions of the, invention can provide a density of at least about 95, 96 or 97 % relative to theoretical density. Moreover, it has been found that such hot zone compositions of the invention. having a density of less than 99 % relative to theoretical density (such as about 95, 96, 97 or 98 % relative to theoretical density) exhibit quite acceptable electrical properties. See, for instance, the results detailed in Example 5 which follows.

The igniters of the present invention may be used in many applications, including gas phase fuel ignition applications such as furnaces and cooking appliances, baseboard heaters, boilers, and stove tops.

The following non-limiting examples are illustrative of the invention. All documents mentioned herein are incorporated herein by reference in their entirety.

EXAMPLE 1

An igniter of the invention was prepared and tested at high voltages as follows.

Hot zone and cold zone compositions were prepared. The hot zone composition comprised 66 parts by volume $Al_2O_3$, 14 parts by volume $MoSi_2$, and 20 parts by volume SiC which were blended in a high shear mixer. The cold zone composition comprised about 50 parts by volume $Al_2O_3$, about 30 parts by volume $MoSi_2$, and about 20 parts by volume SiC which were blended in a high shear mixer. The cold zone composition was loaded into a hot press die and the hot zone composition was loaded on top of the cold zone composition in the same die. That combination of compositions was hot pressed together at 1300° C. for 1 hour in argon at 3000 psi to form a billet of about 60–70% theoretical density. The billet was then machined into tiles that were about 2.0 inches by 2.0 inches by 0.250 inches. Next, the tiles were hot isostatically pressed (HIPed) at 1790° C. for 1 hour at 30,000 psi. After HIPing, the dense tiles were machined to the desired hairpin geometry. The formed igniter performed well at 230 V with good resistivity of about 1.5 ohm cm, a time to ignition temperature of about 4 seconds, and showed stability up to at least 285 V (285 V test voltage being the limit of the test equipment), thus demonstrating that the igniter was effective at high nominal voltages and over a wide range of high line voltage.

EXAMPLE 2

A further hot zone composition was prepared that contained 67 parts by volume $Al_{23}$, 13 parts by volume $MoSi_2$, and 20 parts by volume SiC which were blended in a high shear mixer. The same cold zone composition was prepared as in Example 1 above, and the hot and cold zone compositions processed, and an igniter formed, by the same procedures as described in Example 1. The formed igniter exhibited similar performance results as described for the igniter of Example 1, thus demonstrating that the igniter was effective at high nominal voltages and over a wide range of high line voltage.

EXAMPLE 3

A further hot zone composition of the invention was prepared that contained 66.7 parts by volume $Al_2O_3$, 13.3 parts by volume $MoSi_2$, and 20 parts by volume SiC which were blended in a high shear mixer. The same cold zone composition was prepared as in Example 1 above, and the hot and cold zone compositions processed, and an igniter formed, by the same procedures as described in Example 1. The formed igniter exhibited similar performance results as described for the igniter of Example 1, thus demonstrating that the igniter was effective at high nominal voltages and over a wide range of high line voltage.

EXAMPLE 4

A still further hot zone composition was prepared that contained 66.4 parts by volume $Al_2O_3$, 13.6 parts by volume MoSi2, and 20 parts by volume SiC which were blended in a high shear mixer. The same cold zone composition was prepared as in Example 1 above, and the hot and cold zone compositions processed, and an igniter formed, by the same procedures as described in Example 1. The formed igniter exhibited similar performance results as described for the igniter of Example 1, thus demonstrating that the igniter was effective at high nominal voltages and over a wide range of high line voltage.

EXAMPLE 5

An additional igniter of the invention was prepared and tested at high voltages as follows.

Hot zone and cold zone compositions were prepared. The hot zone composition comprised about 66 parts by volume $AO_2O_3$, about 14 parts by volume $MoSi_2$, and about parts by volume SiC which were blended in a high shear mixer. The cold zone composition comprised about 50 parts by volume $Al_2O_3$, about 30 parts by volume $MoSi_2$, and about 20 parts by volume SiC which were blended in a high shear mixer. The cold zone composition was loaded into a hot press die and the hot zone composition was loaded on top of the cold zone composition in the same die. That combination of compositions was hot pressed together at 1800° C. for 1 hour in argon at 3000 psi to form a billet of about 97% theoretical density. The billet was then machined into tiles that were about 2.0 inches by 2.0 inches by 0.250 inches. Those tiles were then directly (i.e., no HIPing) machined into igniter elements having hairpin geometry. The formed igniter performed well at 230 V with good resistivity of about 1 ohm cm, a time to ignition temperature of about 5 seconds, and showed stability up to at least 285 V (285 V test voltage being the limit of the test equipment), thus demonstrating that the igniter was effective at high nominal voltages and over a wide range of high line voltage.

The invention has been described in detail with reference to particular embodiments thereof However, it will be appreciated that those skilled in the art, upon consideration of this disclosure, may make modifications and improvements within the spirit and scope of the invention.

What is claimed is:

1. A sintered ceramic igniter element comprising two cold zones with a hot zone disposed therebetween, the hot zone comprising a hot zone composition that comprises:

(a) an electrically insulating material;

(b) at least about 3 vol % of a semiconductive material; and (c) a metallic conductor having a resistivity of less than about $10^{-2}$ ohm-cm, wherein at least about 30 vol % of the hot zone composition comprises a metal oxide insulating material.

2. The igniter of claim 1 wherein the insulating material of the hot zone composition consists of metal oxide.

3. The igniter of claim 1 wherein the metal oxide of the hot zone composition comprises aluminum oxide.

4. The igniter of claim 1 wherein the metal oxide of the hot zone composition comprises one or more of aluminum oxide, metal oxynitride, magnesium aluminum oxide and silicon aluminum oxide.

5. The igniter of claim 1 wherein the insulating material of the hot zone composition contains one or more materials selected from the group consisting of a nitride, a rare earth oxide, and a rare earth oxynitride.

6. The igniter of claim 1 wherein the insulating material of the hot zone composition comprises aluminum nitride.

7. The igniter of claim 1 wherein the semiconductive material of the hot zone composition comprises silicon carbide.

8. The igniter of claim 1 wherein the metallic conductor of the hot zone composition is molybdenum, disilicide.

9. The igniter of claim 1 further comprising a cold zone composition that comprises from about 15 to 50 vol % of an insulator material; 0 to 50 vol % of a semiconductive material; and 20 to 70 vol % of a metallic conductive material.

10. The igniter of claim 9 wherein the cold zone insulator material comprises aluminum nitride or aluminum oxide, or mixtures thereof; the cold zone semiconductive material comprises silicon carbide; and the cold zone conductive material comprises $MoSi_2$.

11. The igniter element of claim 1 wherein at least about 40 vol % of the hot zone composition comprises a metal oxide insulating material.

12. The igniter element of claim 1 wherein at least about 50 vol % of the hot zone composition comprises a metal oxide insulating material.

13. The igniter element of claim 1 wherein at least about 60 vol % of the hot zone composition comprises a metal oxide insulating material.

14. The igniter element of claim 17 wherein at least about 40 vol % of the hot zone composition comprises a metal oxide insulating material.

15. The igniter element of claim 17 wherein at least about 50 vol % of the hot zone composition comprises a metal oxide insulating material.

16. The igniter element of claim 17 wherein at least about 60 vol % of the hot zone composition comprises a metal oxide insulating material.

17. A sintered ceramic element comprising a cold zone and a hot zone, the hot zone comprising a hot zone composition that comprises a metal oxide in an amount of at least about 30 vol % of the hot zone composition.

18. The igniter of claim 17 wherein the metal oxide comprises aluminum oxide.

19. The igniter of claim 17 wherein the metal oxide comprises one or more of aluminum oxide, metal oxynitride, magnesium aluminum oxide and silicon aluminum oxide.

* * * * *